United States Patent [19]

Derus

[11] Patent Number: 4,593,419

[45] Date of Patent: Jun. 10, 1986

[54] FLUSH VALVE CONTROL FOR WATER CLOSET

[76] Inventor: Gene A. Derus, 4784 W. Highway KK, R.R. 4, Appleton, Wis. 54911

[21] Appl. No.: 666,257

[22] Filed: Oct. 29, 1984

Related U.S. Application Data

[63] Continuation of Ser. No. 385,107, Jun. 4, 1982, abandoned.

[51] Int. Cl.[4] ..... E03D 1/14; E03D 3/12

[52] U.S. Cl. ..... 4/324; 4/325; 4/388

[58] Field of Search ..... 4/324, 392, 325, 405, 4/326, 407, 388, 378

[56] References Cited

U.S. PATENT DOCUMENTS

| | | | |
|---|---|---|---|
| 2,741,776 | 4/1956 | Christie et al. | 4/324 |
| 2,869,141 | 1/1959 | Koch et al. | 4/388 |
| 2,883,675 | 4/1959 | Hartman, Jr. | 4/324 |
| 3,320,622 | 5/1967 | Wustner | 4/325 |
| 3,324,482 | 6/1967 | Wustner | 4/325 |
| 3,331,084 | 7/1967 | Wustner | 4/325 |
| 3,365,730 | 1/1968 | Chiappetta | 4/325 |
| 3,546,715 | 12/1970 | Wustner | 4/325 |
| 3,590,395 | 7/1971 | Wustner | 4/324 |
| 3,812,545 | 5/1974 | Lanahan | 4/324 |
| 3,858,250 | 1/1975 | Coglitore | 4/324 |
| 4,044,407 | 8/1977 | Silcox | 4/325 |
| 4,175,296 | 11/1979 | Goldman | 4/325 |

*Primary Examiner*—Henry K. Artis

*Attorney, Agent, or Firm*—Andrus, Sceales, Starke & Sawall

[57] ABSTRACT

A buoyancy control unit for the flapper-type ball valve of a water closet flushing unit includes a flexible air release metering tube of a smooth plastic connected to the outer peripheral portion of the flapper valve ball and extended upwardly from the stored water level. An adjustable meter valve is secured about the tube to adjustably collapse the tube for metering flow of air. A simple strap hanger has an offset apertured support tab through which the tube passes and on which the meter valve rests. The opposite strap end is bent and hooked over the edge of the tank. A stick pin is secured in the ball end of the tube and the tube is secured in a pin threader which passes through the opened bottom of the ball and the tube opening to insert the tube with the pin abutting the interior of the float ball.

10 Claims, 6 Drawing Figures

FLUSH VALVE CONTROL FOR WATER CLOSET

BACKGROUND OF THE PRESENT INVENTION

This application is a continuation of my prior application Ser. No. 385,107, filed June 4, 1982, now abandoned and the invention relates to a flush valve for a conventional water closet and particularly to a water saving flush valve for minimizing the volume of water used per flushing cycle.

Sanitary water closets have for years been constructed with a water storage tank secured to the back side of the toilet bowl. The tank is connected to the domestic water supply. An automatic fill valve mechanism in the tank includes a float-operated valve for filling of the storage tank to a selected level. Normally, tanks are presently constructed to hold between six and eight gallons of water. The bottom of the storage tank is connected to the toilet bowl with a normally closed ball valve structure. A flush handle on the storage tank is coupled through a linkage mechanism to the ball valve. Opening of the valve discharges the stored water from the tank for flushing of the toilet bowl. For many years, a simple float ball valve on a suitable guide stem was used. More recently, a flapper-type ball valve is also used, wherein the ball valve is secured by a rubber hinge directly to the overflow tube. Actuating of the flush handle results in the lifting and pivoting of the ball valve about the rubber hinge.

The ball valve is, in both constructions, conventionally a soft rubber ball-shaped member having a bottom opening aligned with the outlet tube to the toilet bowl. The flush raises the ball from the outlet tube opening. The ball is filled with air, when it is trapped, when the bottom of the ball is covered with the water. The resulting buoyancy of the air-filled ball is such that once raised, it maintains the raised position until essentially all of the water has been discharged through the outlet opening, at which time the weight of the ball is sufficient to drop into closing engagement with the tube.

Under certain conditions a full discharge of the stored water may be necessary to completely flush the toilet bowl. In the great majority of the cycles, a substantially lesser volume of water will effect a full and complete flushing of the toilet bowl.

Various systems have been suggested to minimize the volume of water used per flushing cycle. This has become a particularly significant factor with the increasing charges assessed by domestic sewer systems. The problem has become significantly important in areas with limited water supplies. For example, in areas in which the users have individual wells, the dropping of the water table in many areas has demanded that the users undertake significant water conservation. In large metropolitan areas, the expense of providing water through the water systems has resulted in significant increases in the cost.

The general problems have significantly increased the desirability of monitoring and controlling the volume of water used in the flushing of water closets and/or the like.

Various flush valves can within limits be adjusted to reduce the volume of water introduced into the storage tank. Other suggestions have included the addition of bulk members, such as bricks into the water tank, such that the water level increases more rapidly and positions the float operated cutoff valve with a reduction in the total volume of stored water. A further suggested means includes varying the bouyance of the flush ball by providing a controlled leakage of the trapped air from the ball. Thus, when the open bottom ball is raised, the water rapidly flows about the outlet opening and the bottom of the ball, and effectively traps air within the ball, creating the buoyance effect. By attachment of a bleed hose to the ball, with a suitable needle valve mechanism and the like connected into the tube, the rate at which the ball loses its buoyancy can be controlled. By adjusting of the valve, the ball is caused to close before complete discharge of stored water such that the particular volume of water discharged from the tank during each flush cycle is reduced. Various air bleed systems are shown in the prior art. Typical patents include Wustner U.S. Pat. Nos. 3,331,084; 3,546,715; Chiappetta 3,365,730; Lanahan 3,812,545; and Coglitore 3,858,250. For example of the above, U.S. Pat. Nos. 3,365,730 and 3,546,715 disclose similar flush valves having air release buoyancy control connections. An air release tube is coupled to the center of the hollow rubber ball valve. The upper end of the tube is coupled to the atmosphere through the conventional pivoting flush handle to provide for the selective exhaust of air. The handle is constructed with a special movement operable to close the release tube and provide for complete drainage of all water, or in the alternative, to allow air passage from the tube and thus the ball valve. Generally, the systems provide an adjustable pin valve secured to the upper end of the tube to adjust the air flow and thereby the buoyancy control. This permits metering the amount of air being released from the rubber ball valve to control the length of time that the ball valve floats before dropping to close the water drain pipe leading from the storage tank to the toilet.

Although such devices provide a satisfactory means for controlling the buoyancy and therefore the volume of water per flush cycle, the valve mechanisms are reasonably complex with a corresponding expense. A pin valve type structure has a tendency to malfunction with time as the result of the exposure of the minerals in certain water, as well as in borne products and the like. Further, the special valve structures incorporated into the handle rotating mechanism tend to require a certain degree of skill in assembly and maintenance and may require the actual use of a plumber.

There is a need for a simple, reliable and relatively inexpensive buoyancy control system.

SUMMARY OF THE PRESENT INVENTION

The present invention is particularly directed to a bouyancy control means particularly adapted for application to a flapper-type ball valve of a flushing valve structure, and is particularly directed to a simple, reliable and effective means of controlling the volume of liquid used per cycle. Generally, in accordance with the teaching of the present invention, a flexible air release metering tube has its lower end secured to the outer peripheral portion of a flapper valve ball. The flexible tube extends upwardly from the ball valve above the level of the normal water level, and is releasably coupled to and mounted to the tank wall. A small clamp valve unit is secured to the tube and includes an adjustable means to adjustably clamp and collapse the tube to establish a variable cross-sectional orifice area and thereby create a metered flow of air. The clamp valve unit is preferably a small plastic unit, such as previously used in the metering of intervenous fluids, thereby permitting highly accurate adjustment of the unit while maintaining reliable operations in the environment of a toilet storage tank. The inventor has also discovered that the use of a smooth plastic tube is of substantial significance in establishing and maintaining optimum system operation. Thus, in accordance of a conventional ball valve flush system the receding of the ball normally establishes a fluid-tight seal. The dropping water in the drain pipe to the toilet bowl tends to create a vacuum condition between the dropping water and the ball valve. The air release tube tends to prevent creation of such vacuum nad allows the rapid movement of the water to the toilet bowl to provide an improved flushing action. The proper advantage, however, can only be obtained with the air passage providing an essentially free-flow of air. Thus, it is important to prevent build-up of foreign material within the tube which would tend to restrict the air flow or the rapid air flow through the tube.

The upper end of the tube can be conveniently mounted by a simple strap hanger having an offset apertured tab through which the tube passes. The clamp valve unit provides a stop such that the tube is secured to the support tab. The opposite end of the strap hanger is readily bent to form a U-shaped hanger which can be attached to the edge of the tank.

The tube can be secured to the ball in any suitable manner. A particularly unique and practical implementation is provided by the forming of the ball valve with an opening of a diameter slightly less than the diameter of the release tube. A thin semi-flexible pin member is secured in the ball end of the tube immediately adjacent to the end thereof. The outer tube end of the tube is secured to a pin threader, as by an opening in the end of the threader, and the threader is passed through the opened bottom of the ball and the tube opening. This stretches the ball about the tube opening to permit ready passage of the tube into and through the opening until the pin bottoms against the interior of the ball, securely placing and locking of the ball valve in place.

The assembly, particlarly in the preferred construction, provides a relatively inexpensive package which can be readily applied to new and existing water closets. The device is mounted without the need of special tools or technique and should be readily applied by the home owner, building maintenance men and the like. The simplification of the apparatus and the installation procedure while maintaining highly effective and reliable flushing control is particularly significant in this day of high cost and/or the like.

DESCRIPTION OF THE DRAWING FIGURES

The drawing furnished herewith illustrates a preferred construction of the present invention in which the above advantages and features are clearly disclosed as well as others which will be readily understood from the following description.

DESCRIPTION OF THE ILLUSTRATED EMBODIMENT

Figure 1:
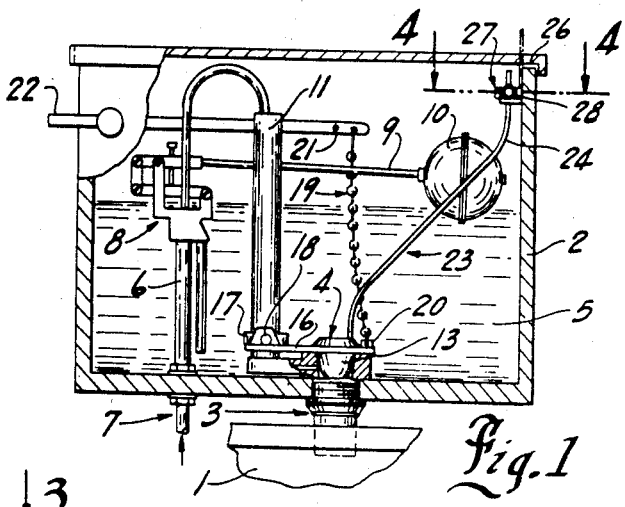
FIG. 1 is a vertical front elevational view of a water closet with parts broken away and sectioned to generally illustrate the flush structure incorporating a buoyancy control constructed in accordance with the present invention.
Figure 2:
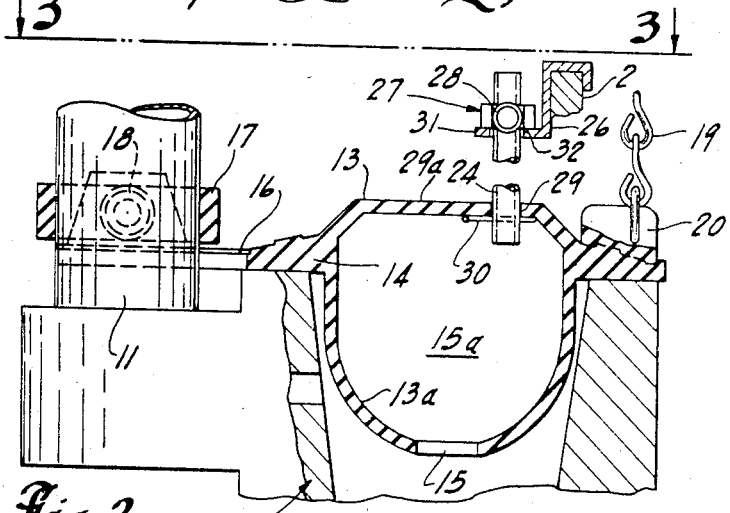
FIG. 2 is an enlarged vertical sectional view through the ball valve unit shown in FIG. 1.
Figure 5:
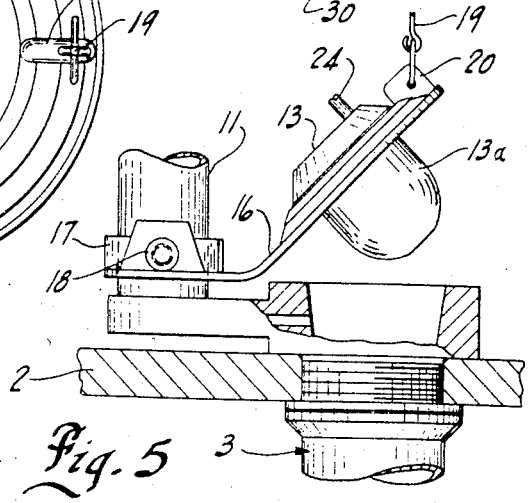
FIG. 5 is a view similar to FIG. 2 illustrating the ball valve in the raised position.

Referring to the drawings and particularly to FIGS. 1 and 2, an embodiment of the present invention is shown applied to a conventional free standing water closet including a toilet bowl 1 of which only a fragmentary portion is illustrated in combination with a back mounted water storage tank 2. A transfer pipe 3 connects the bottom of the water storage tank 2 to the top of the toilet bowl, not shown. A ball valve unit 4 seats in the upper end of the transfer pipe 3 within the water storage tank 2. With the ball valve unit 4 in the seated position, the pipe 3 empties into the toilet bowl 1 and allows filling of the storage tank with water 5 to a selected level. When the ball valve unit 4 is raised, as shown in FIG. 5, the stored water flows under gravity force from the storage tank 2 into the toilet bowl 1 to flush the bowl.

The flushing action is in accordance with standard conventional functioning. The water storage tank 2 is provided with a water supply system of any suitable and well known construction. Generally, a fill or supply pipe 6 is secured to the bottom wall of the storage tank. A supply line 7 from the domestic water system is connected through the bottom wall to the lower end of the supply pipe 6. A fill control valve 8 is secured to the upper end of the supply pipe 6. The control valve 8 includes a pivotally mounted control arm 9 with a float member 10 secured to the outermost end thereof. The float member 10 tends to drop under the force of gravity to open the valve 8. In accordance with known functioning, the water and float 10 rise in the storage tank 2 pivoting the arm 9 upwardly, and at the selected full storage level. The valve 8 closes to thereby provide a predetermined volume of stored water 5 within the storage tank 7. An overflow tube 11 is secured to the bottom wall and connected to the transfer pipe to the toilet bowl. The ball valve unit 4 is shown including a conventional flapper ball valve construction. A soft rubber hollow ball-type element 13 has a flat sealing wall 14 with a semi-spherically shaped bottom wall extension 13*a*. The flat wall 14 seats on the upper end of the transfer pipe 3 with the extension 14 protruding into the pipe. The bottom wall has a central opening 15 to allow the ball to fill with air when seated on pipe 3. A pair of pivot arms 16 are integrally connected to the upper sealing wall 13 and extend laterally outwardly thereof. A mounting ring 17 is secured to the arms 16 as by molded pivot pin 18 and is adapted to slide down over the overflow pipe 11 to locate the flapper aligned with and located within the transfer pipe 3. A flexible chain or other mechanism 19 is secured to a plate tab 20 on the outermost end of the wall 13 and extends upwardly to a pivoting flush arm 21, which is coupled to the flush handle 22 on the front wall of the storage tank 2, as in a conventional system.

To flush the toilet, the user pivots the handle 22 in the conventional manner. The ball valve unit 4 is lifted upwardly from the transfer pipe 3 into the stored water 5. The buoyancy of the air filled ball 13 is such that the ball valve remains raised in the water 5. In accordance with the present invention, an air bleed buoyancy control unit 23 is secured to the ball valve unit 4 to permit control of the buoyancy characteristic thereof. In particular, an air bleed tube 24 is specially secured to the ball valve unit 4 and extends upwardly through the storage water 5 of the storage tank 2. The upper end of the tube 24 is supported above the top level of the stored water 5 by a special support bracket 26. A meter valve 27 is located over an upper end of tube 24 within tank 2 and includes an adjustable rod member 28 adapted to selectively collapse the tube 24 and thereby provide a control orifice within the bleed tube; thereby controlling the rate of air movement through the tube 24.

When the valve unit 4 is raised into the water of the storage tank, the air is trapped by the water within the chamber 15*a* and creates a buoyancy which maintains the ball in a raised position as the water level drops.

In operation the meter valve unit 27 provides a metered release of air from the ball valve unit 4, with a corresponding controlled increased control rate of drop of the ball valve. This results in a discharge of only a proportionate part of the stored water 5 and requires only partial refill to raise the upper level and produce a desired pressure head.

The total discharge of the water in the storage tank can be readily provided by merely holding of the flush handle down for a couple of additional seconds. This type of action is required infrequently and there is really no necessity for providing a separate interlock, such as a suitable means to close off the upper end of the tube.

The water filling structure, as well as the flushing mechanism as such, may be of any conventional or desired construction, and that shown is a known typical construction. Consequently no further description is given other than as necessary to fully explain and illustrate the embodiment of the present invention with the several advantages and features resulting from the unique construction of the present invention.

Figure 3:
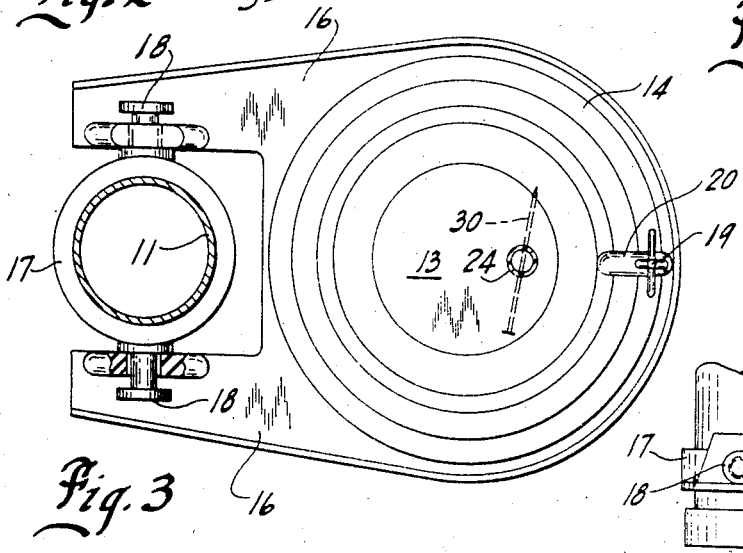
FIG. 3 is a plan view taken generally on line 3—3 of FIG. 2 more clearly illustrating the metering control valve of the illustrated embodiment of the invention.

More particularly and as more fully shown in FIGS. 1–3, the air release tube 24 is a flexible plastic tubing which extends through an opening 28 provided in the upper wall 29 of the ball valve 13. The tube 24 is specially selected of a plastic having an exceptionally smooth inner surface and formed of a material which minimizes build-up of foreign matter within the tube. For example, the inventor has found that a plastic tube, such as that manufactured and sold by under the trademark TYGON provides an exceptionally satisfactory tube construction. The tube 24 has the desired smooth surface and anti-buildup characteristic as well as maintaining its flexibility over a long period while in a water environment.

The lower end of the tube 24 is fixed within opening 28 in the ball valve. In the illustrated embodiment of the invention, the tube 24 is specially secured in place with a thin, noncorrosive pin 30 which extends through the tube 24 within the ball valve 13.

In the illustrated embodiment of the invention, the opening 28 and the interconnected air tube is specially located on an outer radius portion of the inner chamber of the ball element 13 with respect to the pivot connection 17. This special location of the bleed tube 24 has been found to provide a particularly and unexpected effective operation of the flush control valve unit. Thus, the bleed opening is placed at or close to the highest point in the initially raised flapper valve unit 4, such as shown in FIG. 5, such that as the ball drops it provides a most effective conjoint operation with the water rising within the chamber of ball valve.

The tube 24 extends upwardly through the stored water 5 with the upper end supported within the bracket 26. In the illustrated embodiment of the invention, the support bracket 26 is a simple metal strap having a small offset tab 31. An opening 32 in the tab 31 is slightly larger than the diameter of the tube 24 and the tube extends freely therethrough. The air release or meter valve 27 is secured to the tube outwardly of the clamp tab 31 and in the secured position rests on the tab to support the tube coupled to the bracket 26. The bracket 26 is initially formed with a flat mounting portion, as shown in phantom in FIG. 1. The bracket 26 is formed of aluminum or other suitable readily bendable material. The user properly locates the tab 31 and then bend the mounting leg portion of bracket 26 to an inverted U for location over the edge of the water storage tank 2, as shown in FIG. 1. Although the bracket could of course readily be preformed, it is preferably constructed to permit on site application for proper location of the air release tube 24 in various tank constructions.

The illustrated meter valve 27 is a clamp unit which has been in use in medical intervenous feeding applications. The clamp unit 27 includes a collar member 33 adapted to slide over the tube 24. A control pin 28 is threaded through an opening in the collar and moves through the collar in alignment with the opposed wall 34 of the collar 33. The inner end of the threaded pin 28 is formed as a smooth curved end, and the opposed wall 34 of the collar is a smooth curved member wall portion.

Figure 4:
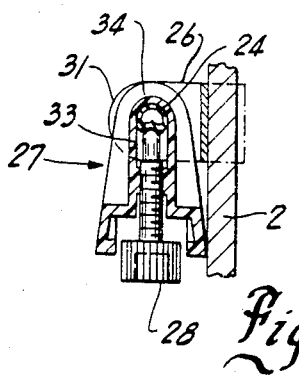
FIG. 4 is a transverse fragmentary horizontal section taken generally on line 4—4 of FIG. 1 and more clearly illustrating the support for the upper end of an air release tube as shown in FIGS. 1–3.

In application, the collar 33 is slipped downwardly over the tube 24 outwardly of the tab 31. The clamping pin 28 is threaded into the collar and into collapsing engagement with the tube 24, which collapses between the smooth curved portions of the collar and pin, as most clearly illustrated in FIG. 4. This restricts the cross-sectional opening area of the tube 24 and provides an air metering orifice. The threaded pin 28 is of a relatively fine thread construction such that the turning of the pin results in accurate proportionate collapsing of the tube and adjustment of the metering opening. This permits close regulation and setting of the air leakage rate from the portion in chamber of the ball valve unit 4 and a corresponding control of the dropping rate of the valve.

In operation the flapper valve unit 4 is mounted in the water tank in place of the existing valve structure. The upper end of the tube 24 is threaded through the support tab 31 and the valve unit 27 loosely applied to the tube 24. The outer end of the bracket 26 is bent to the U-shaped configuration to locate the tab 31 slightly above the normal level of the water 5. The meter valve pin 28 is then adjusted to provide a partial closing of the tube 24. The tank 2 is then flushed and the dropping of the level of water 5 and the time ball valve closure noted in relation to the flushing action. If the water level has dropped by approximately 50% and the flushing action is completely satsifactorily, the meter valve unit 27 has been appropriately set.

If either the flushing action is not complete, or an excessive amount of water has been discharged, the meter valve is adjusted accordingly. To increase the discharge of water, the meter valve 27 is closed slightly.

Closing of the valve of course reduces the rate of air flow and maintains the buoyancy of the ball valve unit 4 for a longer priod to delay its closing. If less water is to be discharged, the meter valve 27 is opened, thereby increasing the rate of discharge air flow and decrease the buoyancy and accelerating the time of closing of the flush valve unit 4.

When the unit is properly set, the user will find that the air release valve creates a final follow-up flushing action after the valve ball element moves to the closed position. Thus, the closed valve unit does not in fact seal the end of the transfer pipe or passageway, but rather as a result of the smooth air release tube permits the final water in the toilet bowl and the passageway to move rapidly into the bowl to produce a hightly effective final flushing action. It would appear that the air bleed is such that the water during the falling action tends to create a force on the air filled ball and tube which upon closure interacts to increase the final flushing action. The invention has been applied in various domestic, institutional and industrial type installations, and has been found to produce unexpected flushing action as well as significant reduction in water usage.

The user can readily mount the unit in the storage tank 2 without the use of special tools or technical skill. Additionally the user can directly and properly adjust the setting of the valve structure. Obviously if designed for any particular water storage unit, the valve unit can be factory adjusted. However, in view of the variations in structures, altitute and the like, the user should normally be provided with appropriate instructions to make the final adjustment for optimum operation of the unit.

Figure 6:
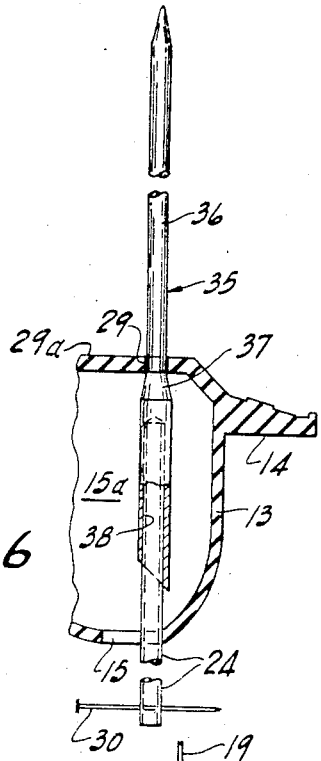
FIG. 6 is a fragmentary view illustrating a preferred method of assembly.

Although within the broadest aspects of the invention, the tube 24 can be secured to the ball valve unit 4 in any desired manner, the inventor has developed a particular system for implementation of the pinned end. The ball valve 13 is preferably preformed with the tube receiving opening 28 of a diameter slightly less than the outer diameter of the tube 24. For example, in one embodiment, the opening was made approximately 2/16 inches in diameter and the outside tube diameter was 3/16 inches. A special tool is provided for convenient assembly of the pinned tube 24 to the ball 13. One embodiment of such an assembly tool is illustrated in FIG. 6. The insertion tool 35 is a single piece pin unit which includes an elongated shaft or pin 36, the outer end of which is provided with a relatively smooth rounded point. The trailing end of the pin 36 is enlarged and connected to pin portion by a smooth cone-shaped portion 37. The trailing end of pin 36 is provided with an end axial opening 38 adapted to receive the outer end of the air released tube 24. The diameter of the opening 38 is generally slightly less than the diameter of tube 24 to provide a frictional gripping thereof.

In assembly, the locking pin 30, which may be a simple stick pin, is assembled with the ball end of the flexible tube 24. The pin 30 may be readily inserted through the wall of the tube 24 without the necessity of any special forming of the tube or the pin. The outer end of air release tube 24 is inserted into the tool opening 38. The insertion pin 36 is then passed through the bottom opening 15 of the ball 13 and the air tube opening 28. The pin 36 moves readily through the opening 28, and portion 37 stretches and spreads the opening 28, to receive the air release tube 24. The smoothness of the tube and the relaxation time of the rubber wall is such that the air release tube 24 is conveniently and readily pulled through the opening 28 until the lock pin 30 engages the interior wall of the ball valve. This locates the tube 24 within the ball valve with a very slight projection of the tube into the chamber 24.

Various modes of carrying out the invention are contemplated as being within the scope of the following claims particularly pointing out and distinctly claiming the subject matter which is regarded as the invention.

I claim:

1. A flush valve control for use in a water closet flush tank having a transfer passageway from the lower end of the tank to a toilet bowl and including a flush valve unit having an air fillable flapper valve member having a bottom opening coupled to the transfer passageway within the tank and said valve member having a pivot mounting means secured to one side of the valve member to permit raising said valve member, an operator connected to said valve member for pivoting the valve member to an inclined position and exposing the bottom opening of the valve member to the water and trapping air within the valve member to maintain buoyancy thereof, an air release unit comprising a flexible tube having a smooth inner surface to provide a free air flow passageway and having an end secured to said valve member, said flexible tube being secured to the outer peripheral portion of the valve member opposite to said pivotal mount and thereby to locate the end of the tube in the highest region of the valve member in the open portion, said tube extending upwardly through the tank and having the upper end located above the water level in the tank, and a meter valve secured to the exterior of the tube and including a collar member encircling the tube and a pin threadedly secured in the collar and engaging the tube to collapse the tube between the pin and the collar and thereby control the cross-sectional area of the tube opening to thereby provide an adjustable air restriction in said passageway and control the rate of buoyancy loss of the flush valve unit.

2. A flush valve control of claim 1 including a strap hanger formed of hand-bendable strap to form a tab at one end and a hanger at the opposite end, and means to secure the upper end of the tube within said tube.

3. The flush valve control of claim 2 wherein said tab includes an opening with the tube passing therethrough, and said meter valve rests on said tab to form said support of the tube with the upper end located above the water level.

4. A float valve apparatus for use in a water storage tank having a bottom passageway connected to the upper end of a toilet bowl and having a float operated fill means for supplying of water to the tank to a preselected level and having a flapper flush valve unit having a ball element within a bottom for opening the transfer passageway for discharging of water into the toilet bowl, said ball element having a pivot support means, a flushing valve handle coupled by a linkage to the valve unit for pivoting the ball element about the pivot support means and exposing the bottom opening of the ball element to the water and trapping air within the ball element to maintain bouyancy thereof, air metering means comprising a flexible tube having one end secured to the peripheral portion of the ball element and located outwardly of and to the opposite side of the ball element from said pivot support means of the ball element to locate the lower end of the tube at a substantially the highest point in the location of the raised flapper ball element, said flexible tube extending upwardly therefrom, means to support the upper end of said tube within the storage tank above the level of water, said meter valve including a collar member encircling the tube and a pin threadedly secured in the collar and engaging the tube to collapse the tube between the pin and the collar and thereby control the cross-sectional area of the tube opening to thereby control the rate of bouyancy loss of the ball valve unit.

5. The float valve apparatus of claim 4 wherein said tube is secured to the outermost edge portion of the ball element.

6. The float valve apparatus of claim 4 wherein said float ball element includes a top wall of a resilient material, said tube opening having a diameter less than the unstressed diameter of said tube to grasp the tube, and a pin passed through the tube to lock the tube with the ball element.

7. The valve apparatus of claim 4 wherein said ball element includes an opening through which said tube extends, said tube having an outside diameter greater than the unstressed diameter of said opening, and a pin means extending through the tube within the ball unit to securely lock the tube within the opening with the inner end of the tube projecting slightly into the valve ball.

8. The method of interconnecting an air release tube to the valve ball of a ball valve-type flush unit having a ball-type element with a bottom opening for a water closet, comprising preforming of a valve ball for said flush unit including an attachment opening in the top wall, said attachment opening having a diameter slightly less than the diameter of the air-release tube, providing a pin inserting member having a first diameter pin portion of a diameter less than the opening and a second pin portion of a diameter greater than said tube, said pin having a length greater than the depth of said valve ball from the bottom opening of the valve ball, to said attachment opening, attaching the one end of the air-release tube to the pin-inserting member, inserting said pin inserting member through the bottom and tube opening in the valve ball, and pulling said pin inserting member through said openings including pulling of the tube through said openings.

9. The method of claim 8 including attaching a stop pin to the end of the tube to be located within the valve ball, and pulling the tube through the tube opening until the flexible pin engages the inner wall of the valve ball.

10. The method of claim 8 wherein said pin inserting member includes a stepped portion having a smooth inclined connecting portion and constructed and arranged to stretch and enlarge the opening in the valve ball to facilitate the movement of the tube through said opening.

* * * * *